US006607316B1

(12) United States Patent
Petteruti et al.

(10) Patent No.: US 6,607,316 B1
(45) Date of Patent: Aug. 19, 2003

(54) PORTABLE LABEL PRINTER

(75) Inventors: Steven F. Petteruti, East Greenwich, RI (US); Majid Amani, Coventry, RI (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/419,137

(22) Filed: Oct. 15, 1999

(51) Int. Cl.[7] ..... B41J 3/54

(52) U.S. Cl. ..... 400/82; 400/88; 400/692; 400/693

(58) Field of Search ..... 400/82, 88, 611, 400/615.2, 621, 604–607, 691–693; 235/462.4, 462.15, 472.02, 375, 383, 385

(56) References Cited

U.S. PATENT DOCUMENTS

| | | | | | |
|---|---|---|---|---|---|
| 4,554,559 | A | | 11/1985 | Heath | 346/76 |
| 4,595,303 | A | | 6/1986 | Kuzuya et al. | 400/82 |
| 4,715,735 | A | | 12/1987 | Kuzuya et al. | 400/82 |
| 4,734,710 | A | * | 3/1988 | Sato et al. | 346/76 H |
| 4,747,707 | A | | 5/1988 | Komori | 400/82 |
| 4,776,711 | A | | 10/1988 | Harada | 400/24 |
| 4,812,060 | A | | 3/1989 | Pailler | 400/82 |
| 4,813,355 | A | | 3/1989 | Stork | 101/288 |
| D322,803 | S | * | 12/1991 | Irie et al. | D18/54 |
| 5,209,583 | A | * | 5/1993 | Lewis et al. | 400/88 |
| 5,267,800 | A | | 12/1993 | Petteruti et al. | 400/88 |
| 5,330,274 | A | | 7/1994 | Schimmelpfennig et al. | 400/82 |
| 5,503,483 | A | * | 4/1996 | Petteruti et al. | 400/88 |
| 5,520,470 | A | * | 5/1996 | Willett | 400/88 |
| 5,679,943 | A | * | 10/1997 | Schultz et al. | 235/472 |
| 5,779,371 | A | * | 7/1998 | Aoyama et al. | 400/120.16 |
| 5,782,567 | A | | 7/1998 | Endo | 400/621 |
| 5,806,993 | A | | 9/1998 | Petterutti et al. | 400/88 |
| 5,813,343 | A | | 9/1998 | Harb | 101/407.1 |
| 6,030,133 | A | * | 2/2000 | Endo | 400/82 |
| 6,168,324 | B1 | * | 1/2001 | Lever et al. | 400/82 |
| 6,270,271 | B1 | * | 8/2001 | Fujiwara | 400/120.01 |

OTHER PUBLICATIONS

Brochure for PS6042 Transportable Multiple Printer System, Comtec Information Systems, Inc., 1993.

* cited by examiner

*Primary Examiner*—Ren Yan
*Assistant Examiner*—Minh Chau
(74) *Attorney, Agent, or Firm*—Kenneth J. Lukacher

(57) ABSTRACT

A portable label printer is provided having a central control section, and first and second printing sections coupled to the central section. Each of the first and second printing sections has a printing mechanism with a thermal printhead and motor driven platen roller, a compartment for receiving a roll of paper, and a cover enabling loading of a roll in the compartment. The central control section has a printer control circuitry which independently controls the printing mechanism of each of the first and second printing sections interactive with signals from a host computer or terminal. Each of the first and second printing sections represents a module detachable from the central control section and can be replaced with another module providing a printing section capable of accommodating printing on different type of paper. One type of terminal is provided which is attachable to the central control section of the printer and can communicate with the printer control circuitry of the printer. The terminal may have circuitry for enabling RF, LAN, voice over Internet, or cell phone communication, and for enabling optical scanning through a window of the terminal. The terminal may be detached from the housing to facilitate its use as a communication device or optical scanner.

28 Claims, 16 Drawing Sheets

PORTABLE LABEL PRINTER

FIELD OF THE INVENTION

The present invention relates to a portable label printer having two printing mechanisms for printing on two different rolls of paper or label stock, and relates particularly to a portable label printer having two printing mechanisms in which each printing mechanism is located in a module detachable from the printer. The printer is suitable for printing on two different types of paper in a single miniature integrated unit. The printer operates interactively with a host computer or a terminal. One type of portable terminal is attachable to the printer of the present invention and can operate as an optical scanner or a communication device.

BACKGROUND OF THE INVENTION

Conventionally, portable miniature label printers have a single print head, such as a thermal printhead, for enabling printing on a single roll of paper or label stock. Examples of portable single printhead printers are described in U.S. Pat. Nos. 5,267,800, 5,806,993, and 5,594,838. One drawback of such printers is that they are limited to printing on only one type of paper at a time from the roll in the printer. Thus, a user of the printer must switch between rolls of different types of paper, which requires time and dexterity to open and reload the paper in the printer. Further, the printer may need to be reprogrammed to provide printing on different types of labels. To avoid switching between rolls, multiple label printers can alternatively be carried by a user. However, this is expensive as it requires purchasing multiple portable printers capable of printing on different rolls. Thus, it would be desirable to provide a label printer having two printheads which are capable of printing on two different types of paper from two different rolls.

Two printheads have been used in Point of Sale (POS) stations in the retail industry, such as described for example in U.S. Pat. No. 5,782,567. These POS stations often have printing devices limited to enabling printing of customer receipts from a roll of paper, and a record of each sale on another roll of paper which is stored on a take-up reel in the printer. Similarly, U.S. Pat. No. 4,747,707 describes a label printer having a first printing device for printing a label, and a second printing device for printing on record paper stored on a take-up shaft in the printer. The second printing device in each of these patents is limited to recording the same information as the first printing device, and thus is not operated independently from the first printing device.

Furthermore, as only one of the printing devices can actually print a label for a user, this printer has the same drawback as the single printhead label printer.

Further, the printhead in a portable label printer is fixably mounted and thus cannot be easily changed or replaced by the typical user if either the printhead is damaged or a different width printhead is needed. Accordingly, it is further desirable to provide a portable printer in which the entire printing mechanism, including the printhead, is in a module which can easily be replaced with another a module having another printing mechanism.

SUMMARY OF THE INVENTION

Accordingly, it is a principal object of the present invention to provide an improved portable printer capable of printing from two different rolls of paper or label stock contained in the printer.

It is another object of the present invention an improved portable printer which is miniature.

A further feature of the present invention is to provide a portable printer having a printing mechanism enclosed in a module which can be easily replaced with another module having another printing mechanism.

Briefly described, a portable printer embodying the present invention includes a housing having a central control section with printer control circuitry, and first and second printing sections coupled to the central section. Each of the first and second printing sections has a printing mechanism with a thermal printhead and a driving motor, and a compartment for receiving a roll of paper. The compartment of each of the first and second printing sections has a hinged cover enabling loading of the roll of paper when the cover in an open position. A platen roller is rotatably mounted in the cover, such that when the cover is in a closed position, the surface of the platen roller faces the printhead and the platen roller is rotationally coupled with the driving motor to drive the paper from the roll across the printhead. The printer control circuitry of the central control system independently controls the printing of the printing mechanism, including actuation of the driving motor, of each of the first and second printing sections interactive with signals from a host computer or terminal. Each of the first and second printing sections represents a module detachable from the central control section which can be replaced with a module providing another printing section. Different modules may be capable of accommodating printing on the same or different types of paper, and may have a different width printhead and roll receiving compartment to print on paper having different widths.

A portable terminal may be attached to the central control section of the printer to communicate with the printer control circuitry. The terminal may have circuitry for enabling RF, LAN, voice over Internet, or cell-phone communication, or for enabling optical scanning through a window of the terminal. The terminal may be detached from the housing to facilitate its use as a communication device or optical scanner. The printer may operate in accordance with commands and data received from the portable terminal, or other terminal or host computer, to send signals to each of the printing mechanisms to print data.

In an another embodiment of the printing sections, each of the first and second printing sections has a printing mechanism with a driving motor, a compartment for receiving a roll of paper, and a hinged cover having a thermal printhead. A platen roller is rotatably mounted in the printing mechanism and rotationally coupled with the driving motor. The cover in an open position enables loading of the roll of paper, and in a closed position, the printhead of the cover faces the surface of the platen roller such that the platen roller can drive the paper from the roll across the printhead. Each of the first and second printing sections can accommodate different width paper by an automatic centering mechanism having two edge guides which retain the roll about its core and are coupled to each other to automatically center the roll with respect to the printhead.

The portable printer of the present invention, in contrast with prior portable label printers, is capable of independently printing on different information on two different rolls. Thus, the printer of the present invention is more flexible than prior art portable printers.

BRIEF DESCRIPTION OF THE DRAWING

The foregoing features, objects, and other advantages of the present invention will become more apparent from the following detailed description when read in connection with the accompanying drawings wherein.

DETAILED DESCRIPTION OF THE INVENTION

Figure 1:
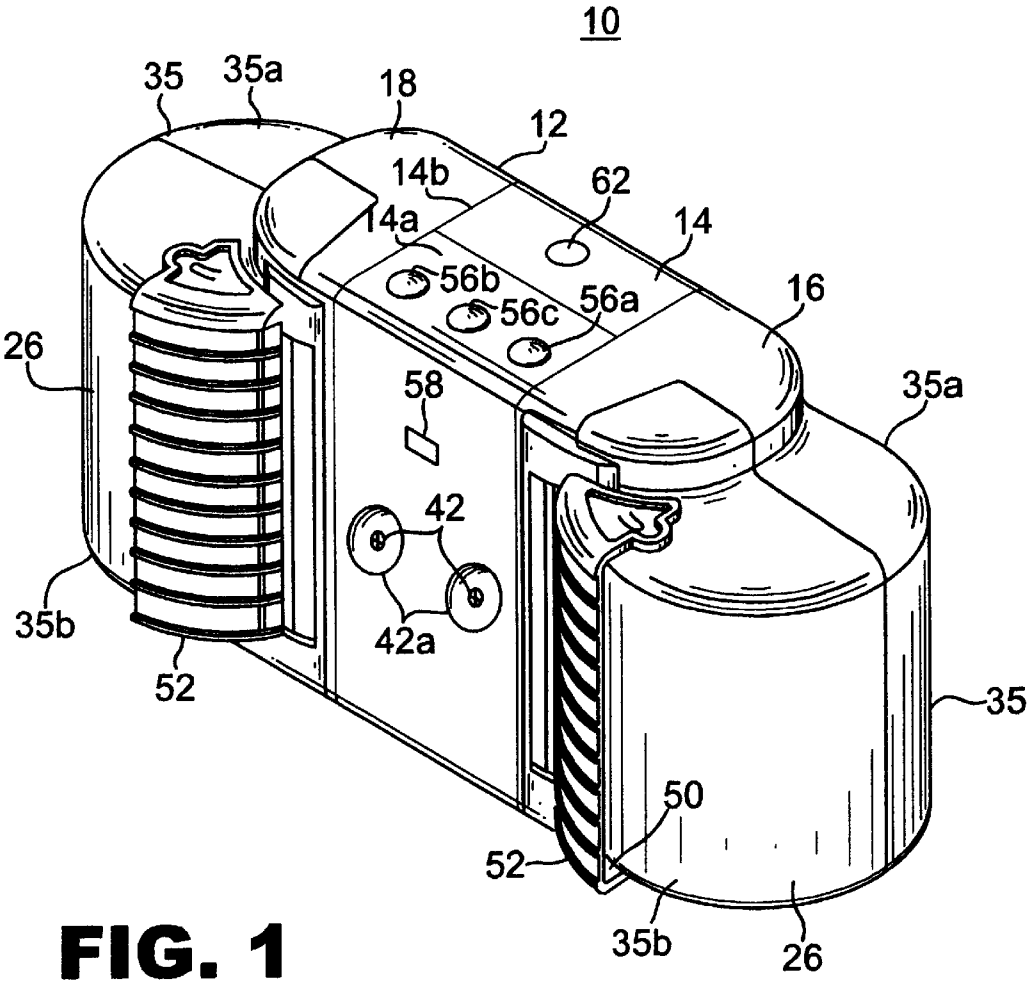
FIG. 1 is a perspective view of a miniaturized portable printer embodying the present invention showing the first and second printing sections of the printer attached to the central control section of the printer, in which the cover of each of the first and second printing sections is in a closed position.
Figure 1A:
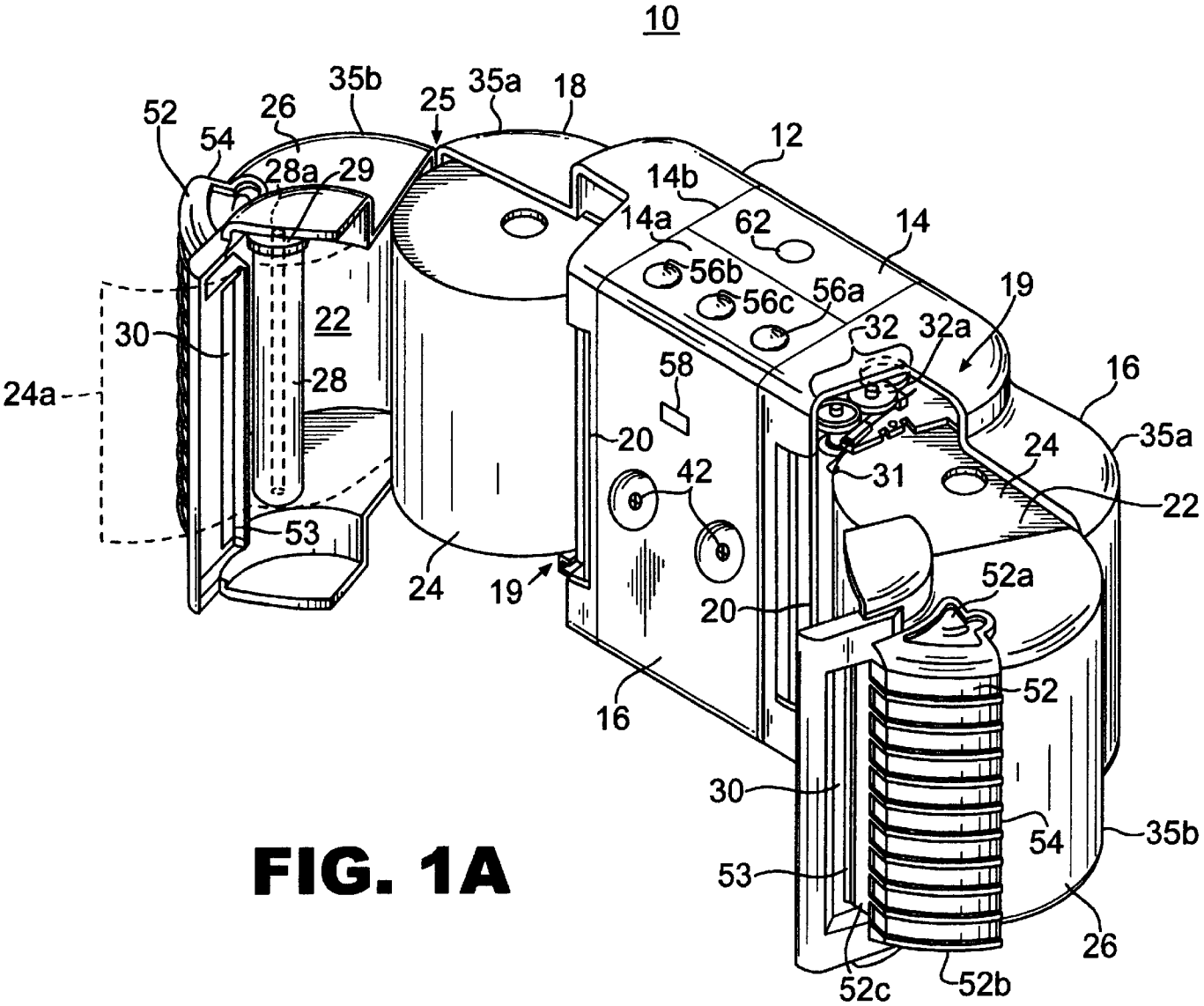
FIG. 1A is another perspective view of the printer of FIG. 1 showing the cover of each of the first and second printing sections of the printer housing in an open position.

Referring to FIGS. 1 and 1A, the portable label printer 10 is shown having a housing 12 having a central control section 14 and first and second printing sections 16 and 18, respectively. Each of the first and second printing sections 16 and 18 includes a printing mechanism assembly 19 having a thermal printhead 20 and a driving motor (not shown), a compartment 22 for retaining a roll of paper or label stock 24, and a cover 26 having a rotatably mounted platen roller 28, as described in U.S. patent application Ser. No. 09/151,591, filed Sep. 11, 1998, now U.S. Pat. No. 6,004,053, which is herein incorporated by reference. As a detailed discussion of these elements is provided in this U.S. Patent Application, only a brief description of these elements follows.

Figure 4:
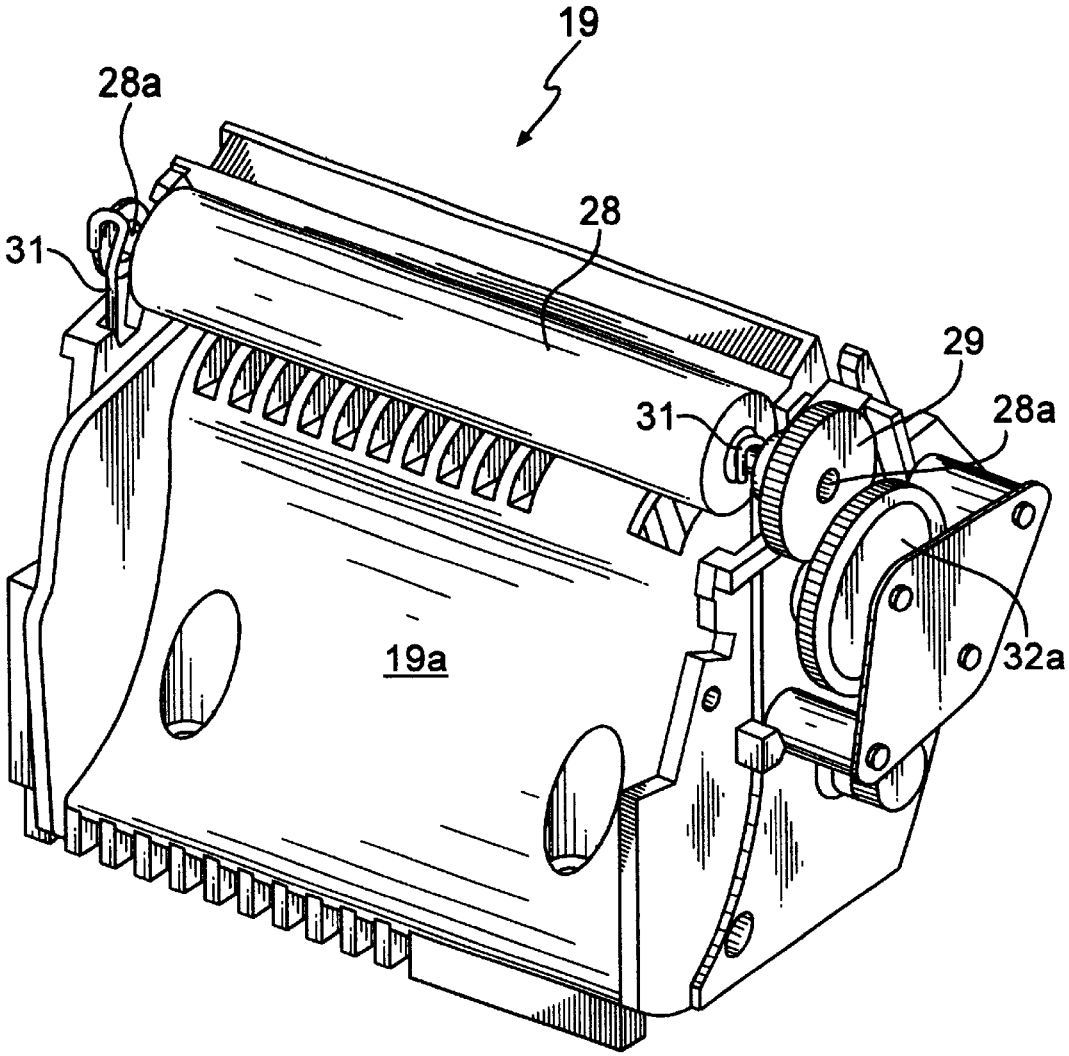
FIG. 4 is a perspective view of the printing mechanism assembly in each of the first and second printing section in which a platen roller of the printing section is included.

When the cover 26 of either the first or second printing sections 16 or 18 is in an open position, a roll 24 can be loaded in compartment 22 of the respective printing section and the paper fed through an opening 30 in cover 26, as best shown in FIG. 1A. End 24*a* of the roll 24 is shown as dashed lines to denote the loading path of the paper through opening 30. Each of the rolls 24 in printing sections 16 and 18 may be spindleless rolls and may be thermally sensitive paper or paper having thermally sensitive labels thereon. Compartment 22 of each printing section 16 and 18 has a contoured interior shaped to receive roll 24, and is slightly larger than the width of the roll to facilitate the roll's rotation as paper is pulled from the roll, and to provide automatic centering of the roll 24 with respect the printhead 20 during printing. When the cover 26 of either the first or second printing sections 16 or 18 is in a closed position, one or more springs in the cover bias the platen roller 28 against the print head 20. A shaft 28*a* supports the platen roller 28 in its associated cover 26 and has a gear 29 rotationally coupled to the shaft of the driving motor via a train of gears 32. Gears 32 are shown in an example of printing section 16 in which gear 32*a* of gear train 32 is coupled to the shaft of the driving motor in printing mechanism assembly 19. As best shown in FIG. 4, two hair pin springs 31 are coupled to the printing mechanism assembly 19 in each printing section 16 and 18 and extends normal to the platen 28 when the cover 26 of the printing section is closed, such that each spring engages an end of the shaft 28*a* of the platen to maintain the cover 26 in a closed position, but releasably from the platen by lifting the cover into an open position.

U.S. patent application Ser. No. 09/151,591 shows a housing having an example of elements contained in the first printing section 16. The first and second printing sections 16 and 18 are identical in terms of components and mirror each other on different ends of the printer 10. The first and second printing sections 16 and 18 can differ to accommodate printing on different types of paper, such as having different widths, as will be described later in connection with FIGS. 4A–4C.

Figure 2:
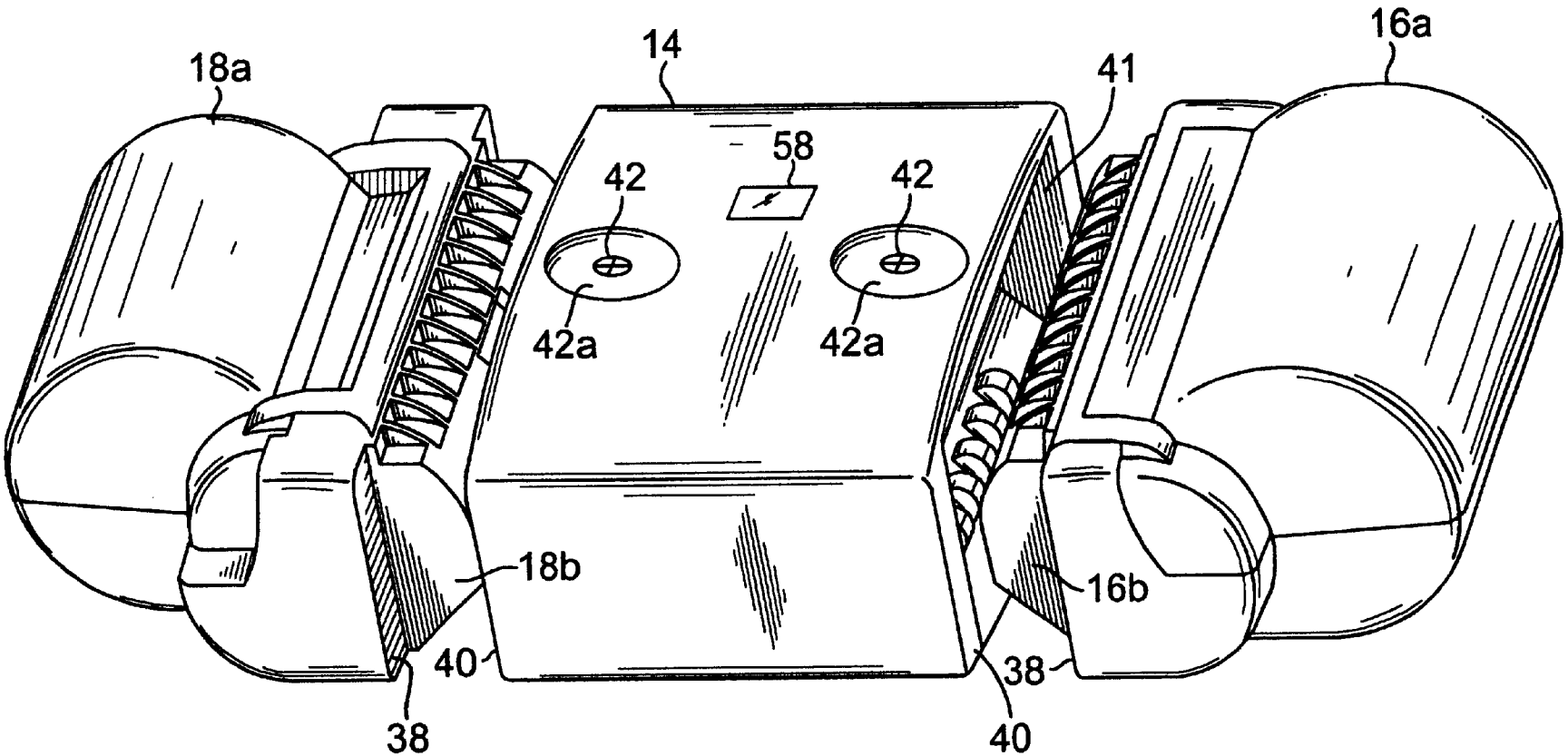
FIG. 2 is another perspective view of the printer of FIG. 1 showing the first and second printing sections as modules detached from the printer.

Each of the printing sections 16 and 18 represents a module 16*a* and 18*a*, respectively, having a casing 35 with a lower member 35*a*, and an upper member 35*b* provided by cover 26, as shown in FIG. 2. The printing sections 16 and 18 are referred to by their respective modules 16*a* and 18*a* in the foregoing discussion, and as modules 16*a* and 18*a* mirror each other for the same width paper roll, identical numerals are used in describing them in the figures. The printing mechanism assembly 19 in each module 16*a* and 18*a* is mechanically mounted, such as by screws, to lower member 35*a*, and may be that shown in FIGS. 4 and 5 of incorporated U.S. patent application Ser. No. 09/151,591. The printing mechanism assembly 19 is shown in FIG. 4 which is identical to FIG. 4 of this incorporated patent application. For each module 16*a* and 18*a*, the compartment 22 is defined by the interior of upper and lower members 35*a* and 35*b*, and the curved surface 19*a* (FIG. 4) of printing mechanism assembly 19. The upper and lower members 35*a* and 35*b* may be made of molded plastic material and mate with each other. The upper member 35*a*, i.e., cover 26, for each module 16*a* and 18*a* is coupled by a hinge 25 (FIG. 1) to the lower member 35*b*. For example, the hinge may be a pin extending through fingers from the upper member 35*a* and fingers from lower member 35*b*. Further, central section 14 may also have an upper member 14*a* and a lower member 14*b* made of molded plastic which mate which each other. One or both of the upper or lower members of the central section 14 provides support for a printed circuit board 33 (FIG. 3).

Figure 3:
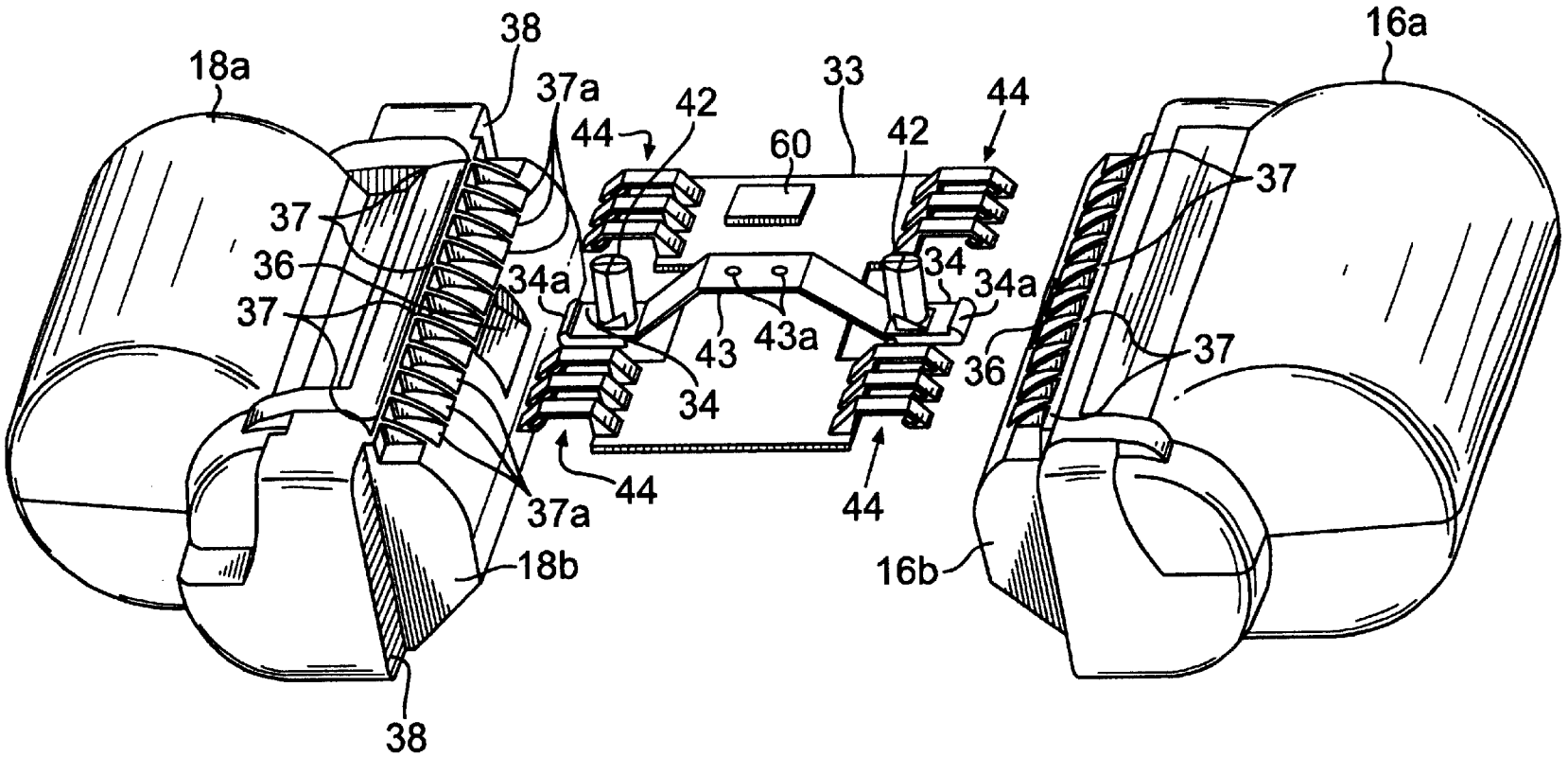
FIG. 3 is another perspective view of the printer of FIG. 2 showing the contacts and latching mechanism on a printed circuit board of the central control section, where the casing of the central control section of the printer is removed.

Referring to FIG. 3, each module 16*a* and 18*a* is attached or detached to or from the central section 14 by a latching mechanism. The latching mechanism for each module includes a tab 34 extending from the printed circuit board 33 of the central section 14, which is insertable into an opening 36 in the module. The tab 34 has a hook 34*a* which is captured by a lip or ledge in opening 36, when an edge 38 of the module properly mates to a corresponding edge 40 (FIG. 2) of the central section 14, thereby locking the module to the central section. The central section 14 has an opening to an inner cavity 41 (FIG. 2) for receiving end 16*b* and 18*b* of the respective module 16*a* and 18*a* on opposite ends of the central section. To release or unlock each module 16*a* and 18*a*, the latching mechanism has a button 42 coupled to tab 34, such that when the button 42 is pressed it pushes down the hook 34*a* of the tab 34 below the ledge in opening 36, thereby unlocking the module and enabling it to be pulled away from the central section 14. The tabs 34 for the locking mechanism for modules 16*a* and 18*a* are coupled by a member 43 to provide added spring bias to the tabs 34 to support each module when locked to printer 10. Member 43 may be composed of metal or other similar rigid material. One or more holes 43*a* may be provided through which screws may extend into the upper member 14*a* to fix the circuit board 33 in the central section 14. The buttons 42 may each be positioned in a recess 42*a* in the upper member 14*a* of the central section 14.

When module 16*a* or 18*a* is latched to printer 10, spring contacts 44 from the printed circuit board 33 are positioned in openings 37 having connectors 37*a* with conductive members for transferring signals between the control circuitry on the printed circuit board 33 and the printer mechanism of the module to enable printing and associated feeding of paper. The control circuitry on the printed circuit board 33 will be described in more detail later in connection with FIG. 8. The signals passed via contacts 44 depend on the particular communication protocol used in printer 10. For example, a first contact may supply power to a module from the central section 14, a second contact supplies a ground signal to the module, a third contact transmits signals to the printing section representing data to be printed by the printhead, the remaining contacts may provide signals from an optical detector in the printing mechanism assembly directed to the paper representing the presence or absence of bars/spaces between labels, or signals from another optical detector in the printing assembly indicating the presence or absence of paper, or other signals representing operational parameters of the printhead or status of the printing mechanism. Such types of optical detectors are described in incorporated U.S. patent application Ser. No. 09/151,591 and in U.S. Pat. Nos. 5,267,800 or 5,806,993. The number of spring contacts 44 and corresponding connectors 37 may vary depending on the signals passed between the central section 14 and each of the modules 16*a* and 18*a* to enable printing and feeding paper from the roll in the module.

Figure 4A:
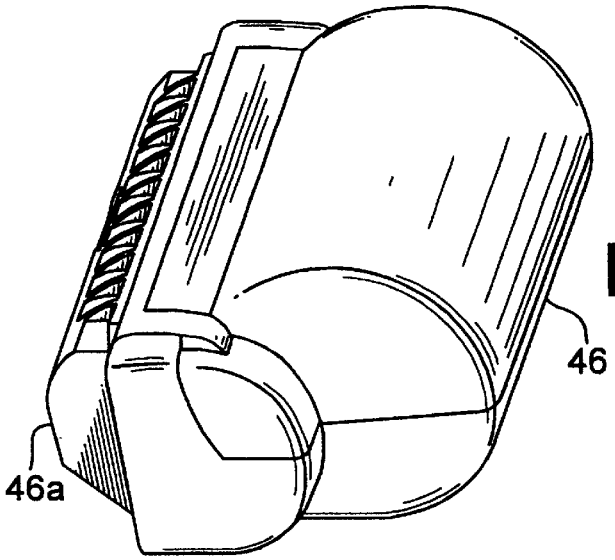
FIGS. 4A, 4B and 4C show different examples of printing sections as modules attachable to the printer of FIG. 1.
Figure 4B:
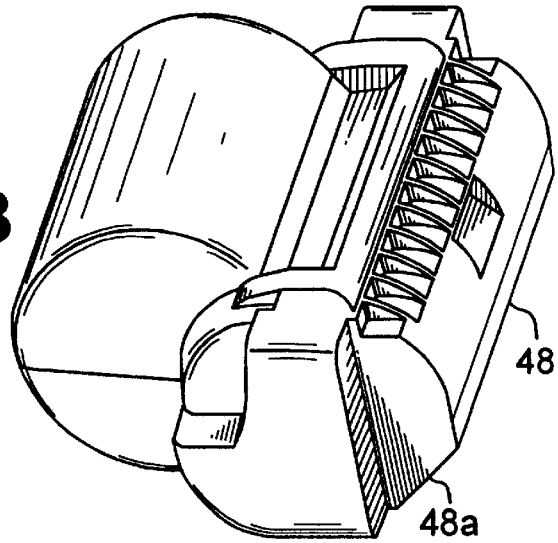
Figure 4C:
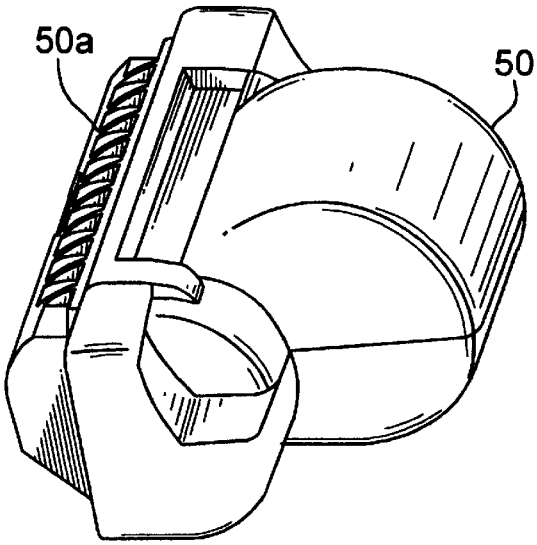

Referring to FIGS. 4A, 4B and 4C, various types of modules attachable to printer 10 are shown. FIG. 4A represents one of the first printing section having a module 46 for providing printing on a four inch roll of paper. FIG. 4B represents one of the second printing sections having a module 48 for providing printing on a three inch roll of paper. FIG. 4C represents one of the first printing section having a module 50 for providing printing on a two inch roll of paper. The difference between the various modules is that the compartment 22, printhead 20, cover 26 and platen 28 have a width to accommodate printing from a desired paper width roll. The end of each module 46*a*, 48*a* and 50*a* are similar in shape such that they are each capable of being received in the central section 14. Thus, the width of the entire printing mechanism assembly 19 is reduced to accommodate the desired paper width for a given module in combination with a reduction of the casing 35 of the module defining the roll receiving compartment 22. Other modules of different widths may similarly be provided for one of the first and second printing sections 16 and 18 of printer 10. With two modules 16*a* and 18*a* attached in printer 10, the printer is a miniature printer weighting less than 2.0 pounds and have a volume of less than 92 cubic inches. Although preferably the printing sections 16 and 18 are modules releasably detachable from the central section 14 of the printer, alternatively, one or both of the printing sections 16 and 18 may be permanently coupled to the central section, or extend from the upper and lower members 14*a* and 14*b* of the central section.

Referring back to FIGS. 1 and 1A, the cover 26 of each printing sections 16 and 18 has an optional movable peeler bar assembly having a curved ribbed member 52 substantially parallel with the surface of cover 26 and two sides 52*a* and 52*b* which couple the curved member to the cover 26. The curved member 52 has a forward portion 52*c* (FIG. 1A) extendable into opening 30 of the cover 26 into which is mounted a rotatable peeler bar 53 parallel to the platen roller 28. Each side 52*a* and 52*b* has a protrusion facing towards the cover which fits into a groove or track in the surface of the sides of the cover, thereby enabling curved member 52 to slide along the cover. At least two positions along the grooves is an indentation in which the protrusions may rest to define a forward and backward lock positions for member 52 to prevent it from sliding. A user may move the curved member 52 to a forward position or back position, such that when locked in a forward position, the peeler bar 53 applies pressure to the platen roller 26 to separate a label from the paper web carrying the label from the roll. Thus, as the paper is advanced by the motor driven platen roller, the label is peeled from its paper web carrier and passes through opening 30 in the cover 26, while the paper web carrier is directed along a path between the cover 26 and the curved member 52 through an opening 54 defined by the surface of the cover and the curved member. When the curved member 52 is moved to a back position, the peeler bar 53 no longer applies pressure to the platen roller, and the label with the paper web extend through opening 30 of the cover. The curved member 52 may be made of a flexible plastic or rubber material, and can be removed from the printer 19 if not needed.

Figure 1B:
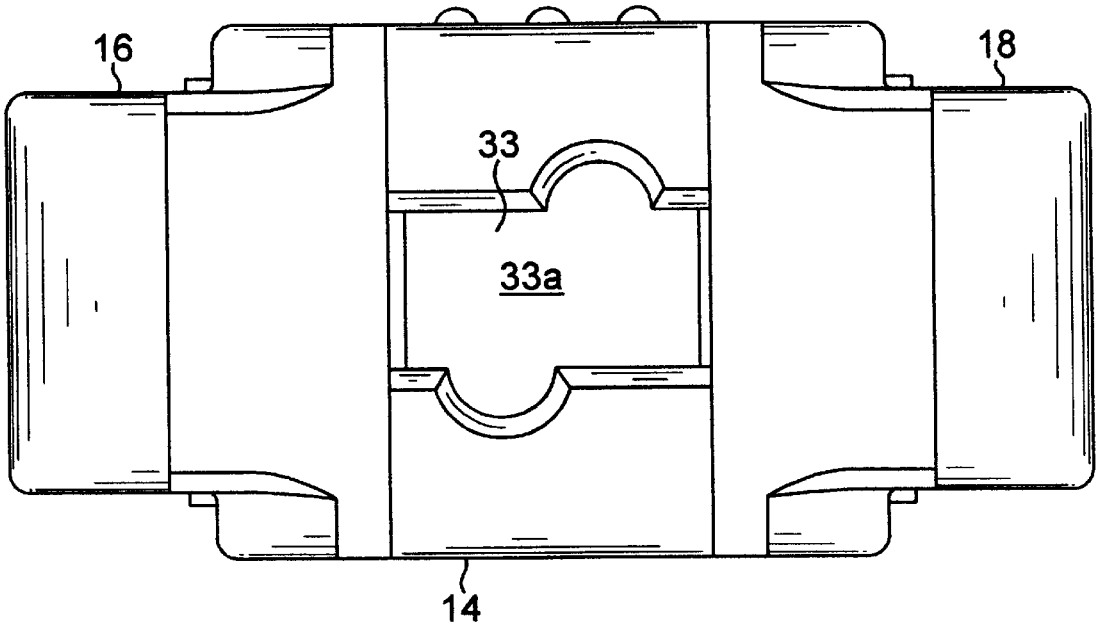
FIG. 1B is a back view of the printer of FIG. 1 showing the battery compartment.

The central section 14 of printer 10 further includes three pin switches 56*a*—*c* coupled to the control circuitry on the printed circuit board 33. Switch 56*a* when pressed instructs the printer to feed the paper of first printing section 16. The printer control circuitry responsive to switch 56*a* sends signals to the printer mechanism of the first printing section 16 to actuate its motor and drive the platen of the printing section without printing data. Switch 56*b* when pressed instructs the printer to feed the paper of the second printing section 18. The printer control circuitry responsive to switch 56*b* sends signals to the printer mechanism of the second printing section 18 to actuate its motor and drive the platen of the printing section without printing data. Switch 56*c* when pressed logically turns on/off the power to printer control circuitry. A battery may be located in a compartment 33 in central section 14 as shown in FIG. 1B to supply power to the printer. The compartment 33 may have a cover 33*a*.

An IR window 58 (FIGS. 1 and 1A) in the central section 14 is in optical communication with an IR transceiver 60 (FIG. 3) on the printed circuit board 33. The IR transceiver 60 enables communication between the printer 10 and another device, such as a keyboard or a terminal carried by the user. Communications with the device may also be through a connector which is exposed in a hole 62 (FIGS. 1 and 1A) in the side of the central section 14. Alternatively, communications with the printer 10 may be via a radio link to a RF transceiver which is housed in the central section 14 adjacent the printed circuit board 33.

Figure 5:
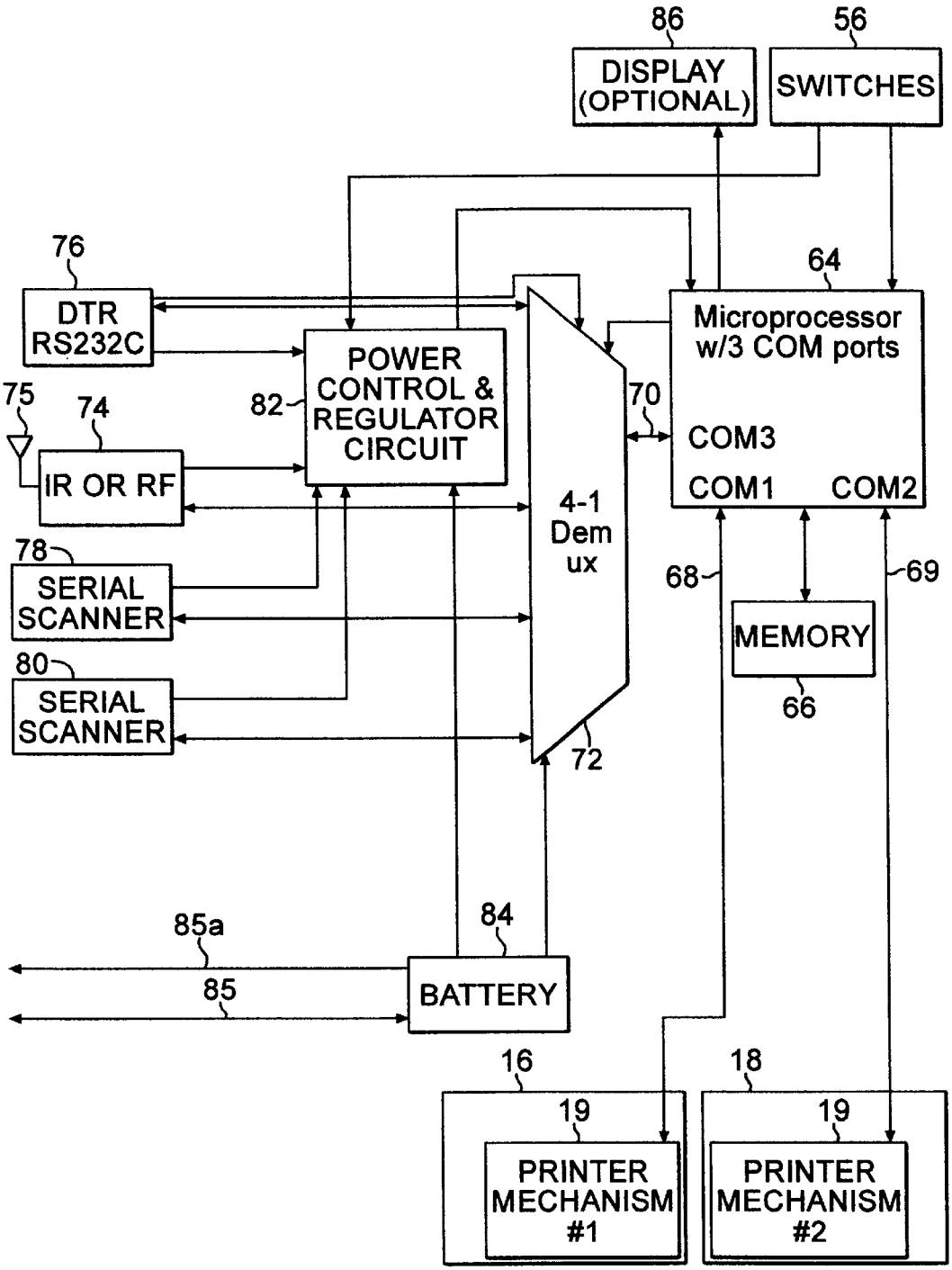
FIG. 5 is a schematic control diagram of a printer in accordance with the present invention.

Referring to FIG. 5, a block diagram of the system is shown including the printer control circuitry residing on the printed circuit board in the central section 14, and the printing mechanisms 19 in printing sections 16 and 18, labeled #1 and #2, respectively. A controller 64 represented by a microprocessor operates in accordance with programmed instructions stored in memory 66 to control the operation of the printer 10 and the printing mechanism in each of the printing sections 16 and 18. Memory 66 may be RAM, FLASH, ROM, or combinations thereof. The controller 64 has at least three communication ports represented by lines 68, 69 and 70. A first communication port 68 couples the controller 64 to the printer mechanism 19 of the first printing section 16 to provide data representing information to be printed and receive information regarding the status of the printhead or signals from any sensors. A second communication port 69 couples the controller 64 to the printer mechanism 19 of the second printing section 18 to provide data representing information to be printed and receive information regarding the status of the printhead or signals from any sensors in the printing mechanism 19. A third communication port 70 receives commands and data from a terminal or host computer through a demultiplexor 72. Such commands are interpreted by the controller 64 to enable the controller to direct the processing (printing) of data following the commands. The demultiplexor 72 is used to select which of the following modality through which communication is to be received or transmitted, an IR or RF (receiver/transmitter) interface 74, an RS232C interface 76, a serial scanner 78, or a serial scanner 80. Scanner inputs 78 and 80 represent two different ports on printer 10 to which data may be received via a cable from an external scanner or other input device. The IR or RF interface 74 is optional, but if a RF interface is present, an antenna 75 is provided. Two select inputs are provided to the demultiplexor to select 1 of 4 possible connections, the IR or RF interface 74, the RS232C interface 76, first serial scanner 78, and second serial scanner 80. The first of the select inputs is coupled to a DTR (data transmit/receive) signal which is high if a signal is present along the RS232C interface, and the second select input is provided from the controller 64. If the DTR signal is high, the controller 64 via a high or low signal on the second select input to the demultiplexor 72 can select between the RS232C interface or serial scanner 78. If the DTR signal is low, the controller 64 can select between input/output using the IR or RF interface 74 and serial scanner 80. The serial scanner 78 or 80 provides input represents data representing a barcode or other symbols which the controller 64 can direct as graphic data to one of the printing mechanisms, or decode if needed.

A power control and regulator circuit 82 supplies power to the controller 64 from a battery 84. The power control and regulator circuit 82 can turn on the controller upon first receiving a signal from one of RS232C interface 76, IR or RF interface 74, or scanners 78 or 80. The controller has an application program which receives control signals, commands and data from the RS232C interface 76, IR or RF interface 78, and operates responsive to such commands to print data from one of the printer mechanisms 19 of the first or second printing sections 16 and 18, as described in U.S. Pat. Nos. 5,267,800 or 5,806,993. Such commands include information indicating which of the first and second printing section 16 and 18 is to print the data. Such data may be characters, barcodes, graphics, lines, or other indicia. For example, each printing section may be referred to by a different printer type command, such as described in U.S. Pat. application No. 09/187,713, now U.S. Pat. No. 6,010,257. Switches 56 represent switches 56*a*—*c*. Switches 56*a* and 56*b* are coupled to the controller 64, and switch 56*c* is coupled to the power control and regulator circuit 82 to turn on/off the printer. For example, power control and regulator circuit 82 may include a flip-flop having a clock input from the signal from switch 56*c*, in which the output state of the flip-flop determines whether power from battery 84 is supplied to other components of the printer. An optional display 86, such as a LCD screen, may be provided, such that the switches 56 can alternatively be used to select settings for the printer 10 displayed on the LCD. For example, the controller 64 upon a user attaching a new module having a printing section for a particular width roll, may select the paper width for that module. Thus, the controller 64 can format data to be printed for each of the printing mechanisms in the printer in accordance with the line width of the printhead associated with that paper width. Other printing parameters may also be selected in this manner for a particular printing mechanism in an attached module, thereby providing enhanced flexibility in printing.

Figure 6:
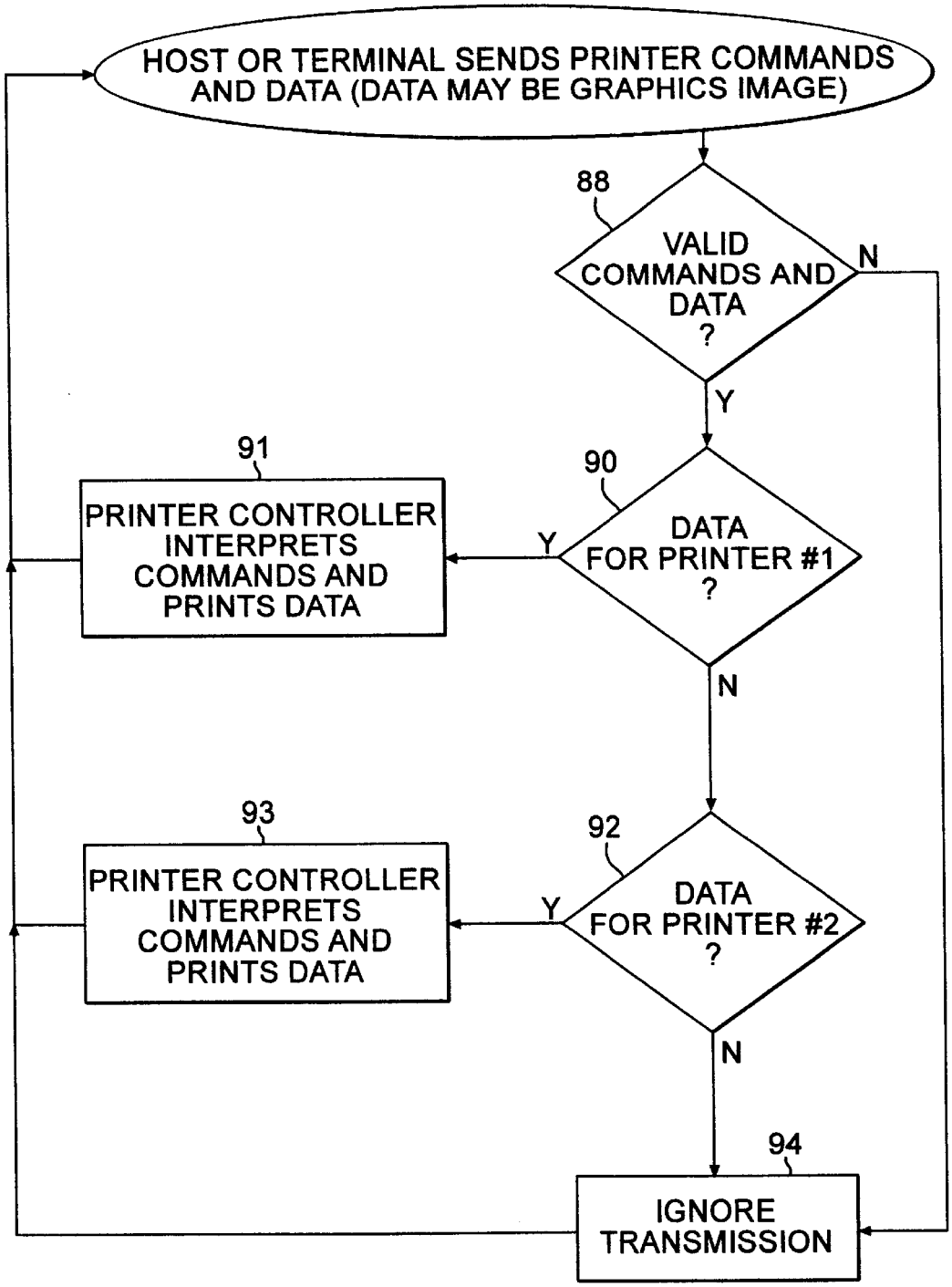
FIG. 6 is a flow chart showing the programming and operation of the printer in accordance with the present invention.

Referring to FIG. 6, a flow chart of the operation and programming of the controller 64 in response to received commands and data is shown. The controller 64 upon receiving a command and data checks if the command (and data) are valid (step 88). The validity of a command is determined by whether it matches a predefined set of valid printer commands stored in memory 66 of the printer. If not, the command and data received are ignored (step 94), otherwise, the controller 64 determines if the command includes an identifier referencing to the printing mechanism of the first printing section (step 90), or the printing mechanism of the second printing section 18 (step 92). If the command indicates the data is for the first printing section 16, the controller 64 interprets the commands and sends the data to the printing mechanism of the first printing section (step 91). If the command indicates the data is for the second printing section 18, the controller 64 interprets the commands and sends the data to the printing mechanism of the second printing section (step 93). The command may include information referencing the width upon which printing of the data is to be provided, such that different width printing may be accommodated by a particular printhead, or the controller 64 may automatically adjust the width in accordance with width information provided previously by the user. The controller 64 at steps 91 or 93 may process the data in accordance with the command prior to sending the data to the printing section, such as format the data for a desired width. If the transmission having the command and data are for neither printer, then the command and data received is ignored (step 94). After the data is printed, the controller waits for the next command and data. In this manner, the printing mechanism in each of the first and second printing sections 16 and 18 is independently controlled by the controller 64.

Although a single controller 64 is shown in the printer, each module may optionally have a microprocessor with memory programmed to interface with the printer control circuitry and share the functionality of the controller on the printed circuit board of the central section of the printer 10.

Figure 7:
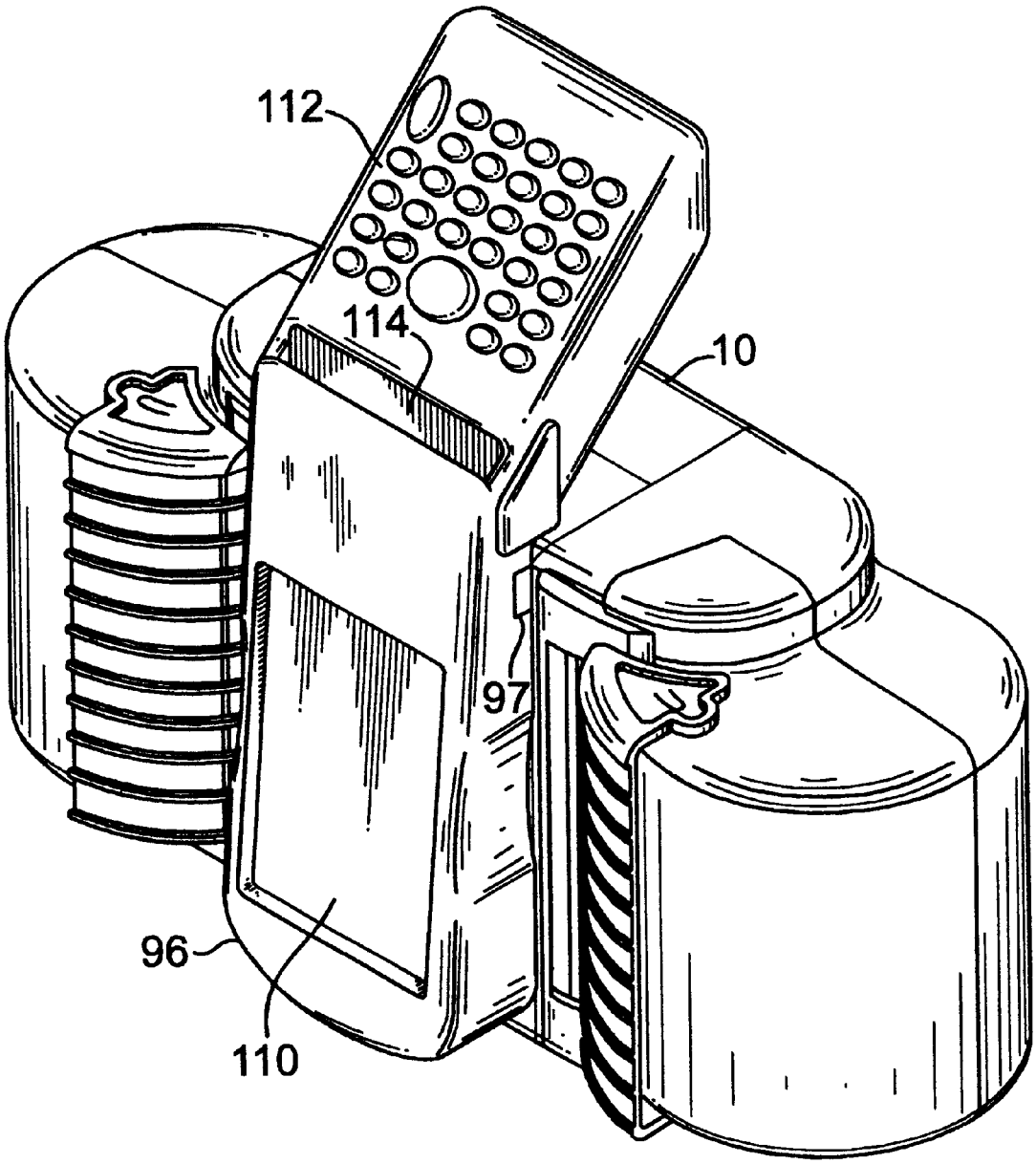
FIG. 7 is a perspective view of the printer of FIG. 1 with an example of a portable terminal attached thereto.
Figure 8:
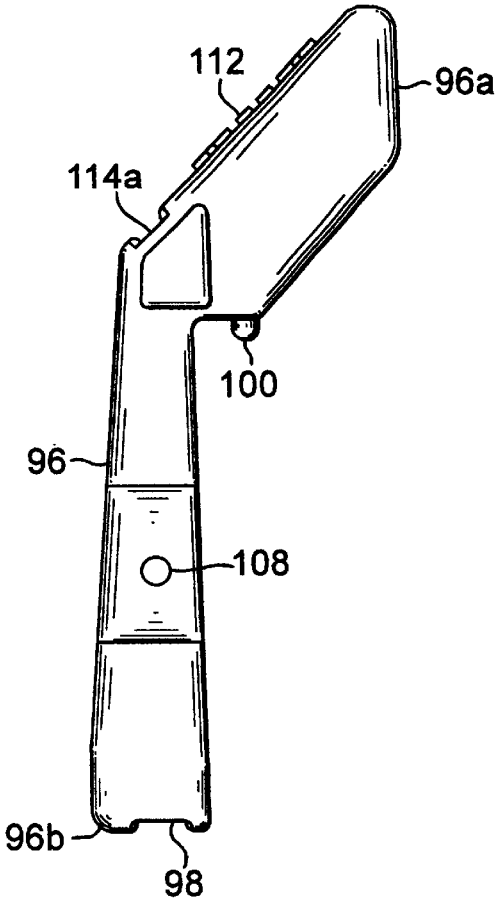
FIG. 8 is side view of the terminal of FIG. 7.
Figure 9:
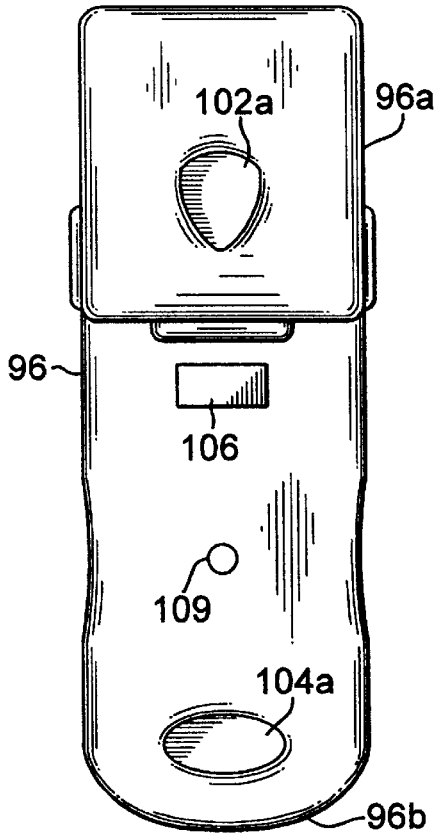
FIG. 9 is a back view of the terminal of FIG. 7.

Referring to FIGS. 7–9, a portable terminal 96 attachable to the printer 10 is shown.

Two tabs (not shown) may extend from the upper member 14*a* and grip indentations along either side of the terminal 96 to lock the terminal to the printer 10, as shown in FIG. 7. The terminal 96 may engage the printer via a set of plastic latches 97 extending from printer 10. For purposes of illustration, one latch 97 is shown in FIG. 7, however two or more latches may be used to couple the sides of terminal 96 to the printer. The ends of the latches may fit or mate into indentations on terminal 96. Other attaching means may also be used, such as latches or tabs extending from the terminal 96 into slots on the printer's central section. The terminal 96 is angled at one end to facilitate its use as an optical scanner when detached from the printer 10. An optical scanner, such as a laser, CCD, or CMOS scanner, is located in the terminal for reading information from a surface through a window 98. Such information may represent a barcode, optical characters, or other symbols. The terminal 96 can be operated as an optical scanner in the hand of a user via a trigger 100 which actuates the optical scanner. A PCMCIA card 114 may be inserted in PCMCIA slot 114*a* to enable additional programmable features or memory to be added to the terminal. Slot 114*a* may be a dual PCMCIA slot for two PCMCIA cards. A PCMCIA card having communication circuitry enabling RF (short range), LAN or cell phone communications can be inserted in slot 114*a*. Alternatively, such communication circuitry may be provided in the terminal 96. In the terminal, such communication circuitry is coupled to audio input circuit 102 having a microphone 102*a* located at one end 96*a* of terminal 96 and an audio output circuit 104 having a speaker 104*a* located at the other end 96*b* of terminal 96. The terminal 96 may be provided by a two-piece construction of molded plastic, in which the end 96*a* of the terminal having ear piece 102 is at an approximately 45 degree angle from the end 96*b* of the terminal 96 having voice input 102. The terminal about ear piece 102 may be contoured to facilitate its placement against the ear of a user. The angular shape of the terminal makes it easier for a user to hold the terminal similar to a telephone handset or typical cell phone. When the terminal 96 is attached to printer 10, an IR window 106 is in optical communication with an IR transceiver in terminal 96 to communicate with the printer 10, or a cable from port 108 from the terminal may be coupled to port 62 (FIG. 1) of printer 10. The terminal 96 further includes a display 110 (which may also provide a touch screen) and a keypad 112 for enabling a user to interface with the terminal and thereby interface with the printer. The display 110, such as a touch screen, or the keypad 112 can also enable the user to enter an address or phone number when the terminal is operating as a communication device. A telescope antenna (not shown) on the terminal may be provided for the communication circuitry.

Figure 10:
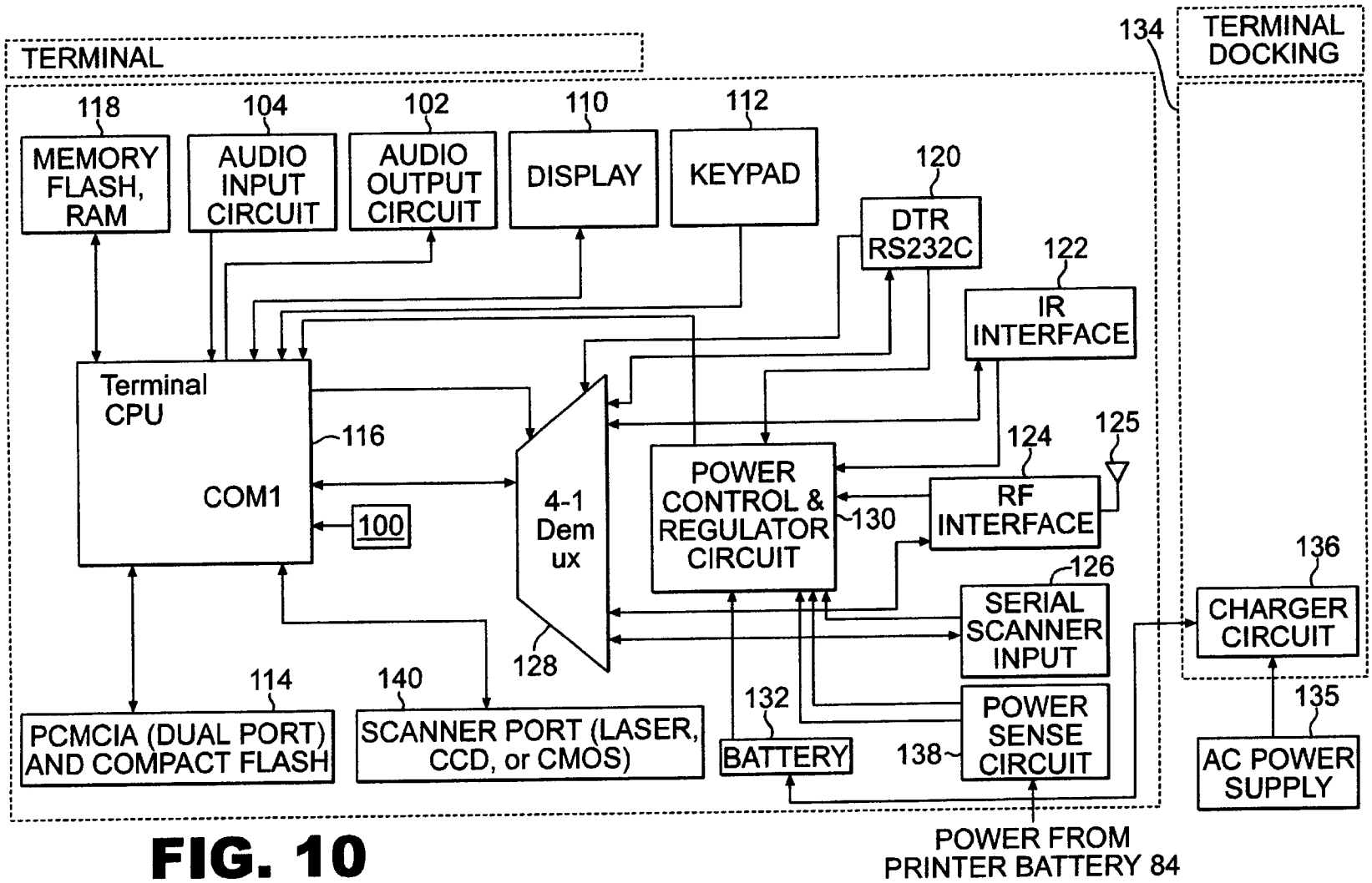
FIG. 10 is a schematic control diagram for the terminal of FIG. 7.

The terminal 96 includes a controller 116, such as a microprocessor, programmed in accordance with software in memory 118, as shown in the block diagram of the terminal of FIG. 10. Controller 116 communicates to printer 10 through one of three modalities, an RS232C interface 120, an IR (receiver/transceiver) interface 122, or an RF (receiver/transceiver) interface 124, and can also receive data from a serial scanner input 126. An external serial scanner may be coupled by a cable to port 108 such that decoded scan data representing barcodes, or other symbols, may be received via serial scanner input 126. RF interface 124 includes a RF antenna 125. Interfaces 122 and 124 are optional in the terminal.

A cable may couple the RS232C interface 120, via port 108, with the RS232C interface 76 (FIG. 5), via port 62, of printer 10. The controller 116 can receive/send data to each of interfaces 120, 122, and 124, or scanner 126, through a 4-to-1 demultiplexor 128. Two select inputs to demultiplexor 128 are provided. The first of the select inputs is coupled to a DTR (data transmit/receive) signal which is high if a signal is present along the RS232C interface 120, and the second select input is provided from the controller 116. If the DTR signal is high, the controller 116 via a high or low signal on the second select input to the demultiplexor 128 can select between the RS232C interface 120 or serial scanner 126. If the DTR signal is low, the controller 116 can select between input/output using the IR interface 122 or RF interface 124.

A power control and regulator circuit 130 provides power to the controller 116, and other components of terminal 96, from a battery 132. The power control and regulator circuit 130 can turn on the controller 116 upon first receiving a signal from one of RS232C interface 120, IR interface 122, RF interface 124, or scanner 126. Controller 116 interfaces with a user through display 110 and keypad 112. The terminal 96 may include a printed circuit board containing the electronics for operating the terminal.

The controller 116 operates in conjunction with the communication circuitry, by coupling the PCMCIA card 114 providing cell phone, LAN, voice over Internet, or RF communication means to the audio output and input circuits 102 and 104, such that communication is provided in accordance with the software of the card 114. A PCMCIA memory card may also be provided in slot 114*a* to add a program the controller 116 or expand the memory of the controller. An optical scanner 140, such as a laser, CCD or CMOS scanner, is coupled to controller 116 and is enabled responsive to the controller receiving a signal from trigger 100. The controller 116 thus can obtain scan data representative of indicia, such as a barcode or characters. The scan data may be decoded in accordance with decoding software appropriate for the scan data and sent as data to the printer 10, or the scan data may represent graphics sent as data to the printer.

Further, the audio input circuit 102 and microphone 102*a* of terminal 96 may be used to receive voice commands from a user which are interpreted by controller 116. The controller 118 operates according to such voice commands which match those stored as valid voice commands in memory 118, as if such commands were entered through the keypad 112 or touch screen display 110.

Battery 132 may be a rechargeable type battery, such as a Lithium Ion 7.2V DC battery, which may plug into a terminal docking unit 134 to recharge the battery or supply external power to the terminal 96. A charger circuit 136 may be coupled to an AC power supply 135, such as to a typical 110 or 120V AC outlet, and transforms the AC Power into a signal for charging battery 132. The docketing unit may be constructed to attach to terminal 96, similar to an attachment to printer 10, in which a port 109 (FIG. 9) of terminal 96, connected to battery 132, is received by a connector of docking unit 132 coupled to charger circuit 136.

Optionally, the power control and regulator circuit 130 of terminal 96 may receive power from battery 84 (FIG. 5) of printer 10 through port 109 (FIG. 9) when the terminal is attached to printer 10 (FIG. 7), via a corresponding connector to battery 84 on the printer 10. A power sense circuit 138 determines when power is being supplied from battery 84 of printer 10, and provides a signal to the power control and regulator circuit 130 to disable supply of power from battery 132. In addition, battery 84 of printer 10 may be of a rechargeable type and can be similarly coupled to charger circuit 136 of docking unit 134 though a port on the central section 14 which is coupled by line 85 to battery 84.

Figure 11A:
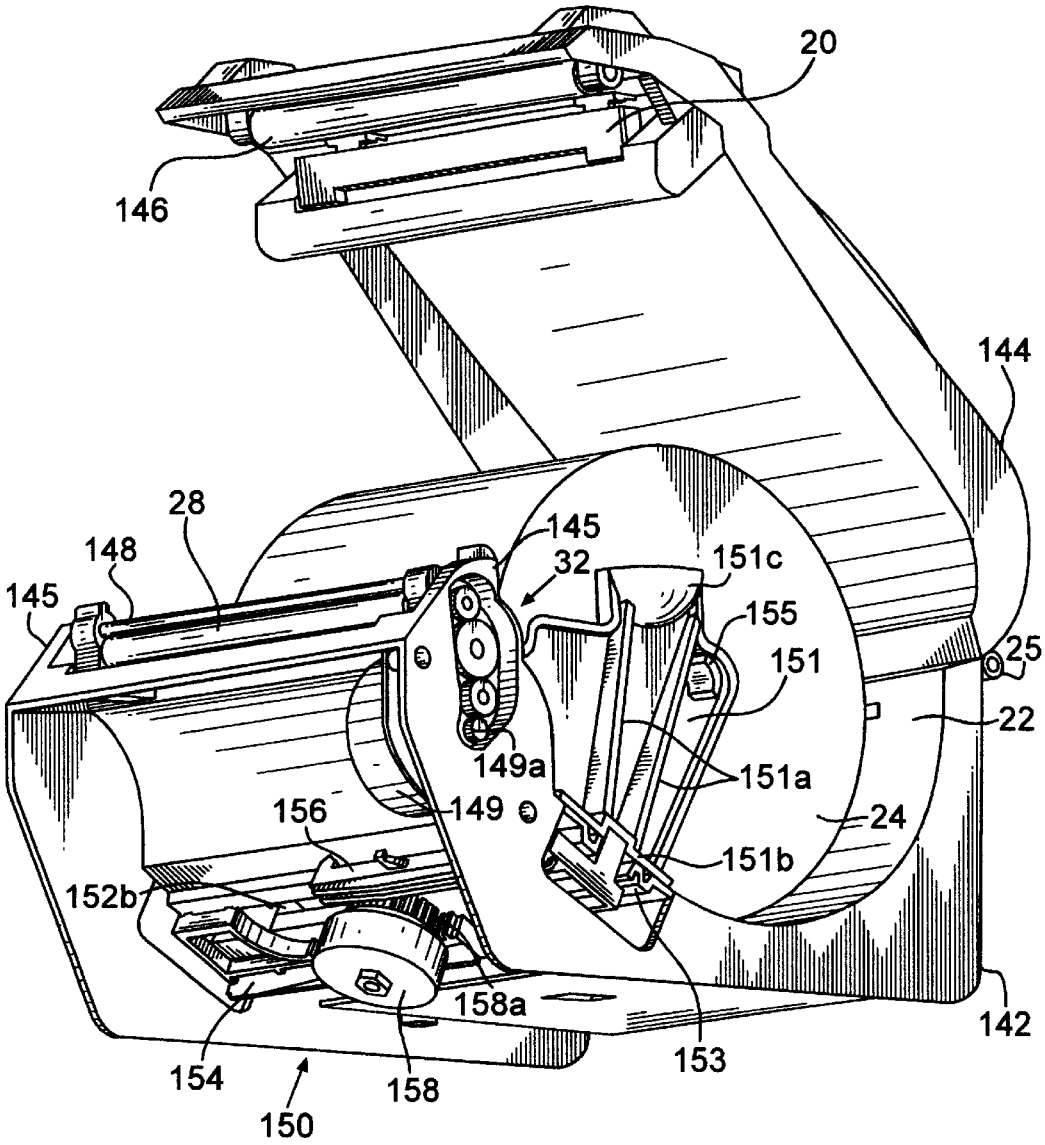
FIG. 11A is a perspective view of another embodiment of the printing sections in the printer of FIG. 1.
Figure 11B:
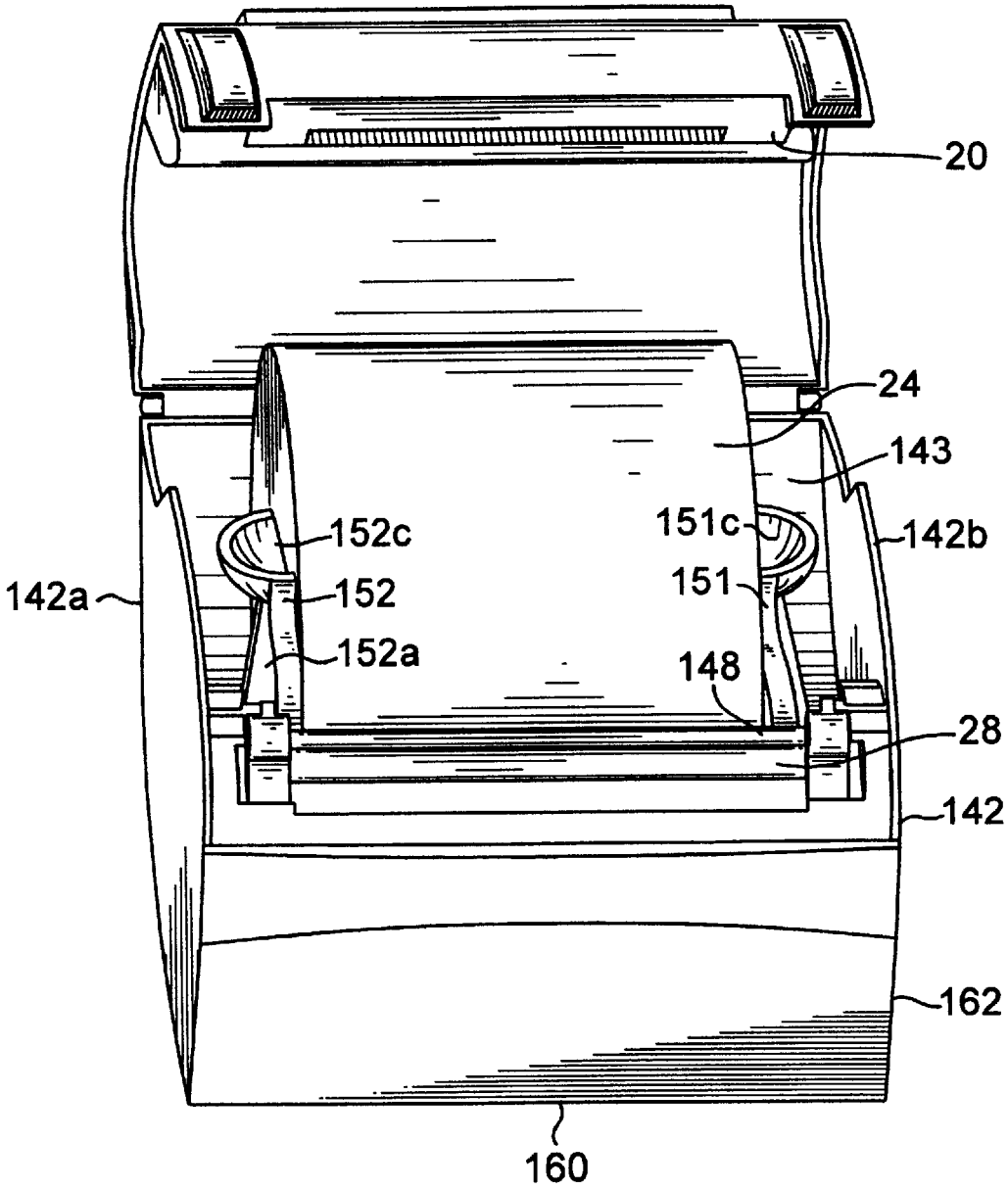
FIG. 11B is another perspective view of the printing section of FIG. 11A.

Referring to FIGS. 11A and 11B, another embodiment of the printing sections 16 and 18 is shown having a housing 142 and cover 144 coupled to the housing by hinge 25. The housing 142 has side walls 142*a* and 142*b* and a curved interior surface 143 shaped to accommodate roll 24. The compartment 22 for the roll is defined by the interior of housing 142, side walls 142*a* and 142*b*, and the interior of cover 144. The platen roller 28 is rotatably mounted on a shaft in the housing between two extending flanges 145. One end of this shaft has a gear rotationally coupled to shaft 149*a* of a drive motor 149 by gear train 32. The thermal print head 20 is mounted in the cover 144, parallel to the platen roller, such that when the cover is in a closed position the print head faces the surface of the platen roller 28.

An optional peel bar 148 may be mounted between flanges 145 adjacent the platen roller, and an optional peeler pinch roller 146 maybe rotatably mounted in the cover 144, such that when the cover 144 is in a closed position with respect to housing 142, the paper from roll 24 is pulled by platen roller 28 between peeler pinch roller 146 and peel bar 148 to separate labels from its base carrier paper. When the cover 144 is rotated to a closed position to engage housing 142, the paper (media) path is adjusted such that a tight radius is formed around the peel bar 148. The base carrier paper (liner) having labels travels a tight radius around the peel bar 148 because the pinch roller 146 forces the liner between itself and the platen roller 28 A user can simply load the roll 24 and extend the paper from the roll over the platen roller 28 and peel bar 148 and close the cover, thereby eliminating the user having to thread the liner. An opening near platen roller 28 is defined between the cover 144 and the housing 142 when the cover is in a closed position. After printing, the liner separated from the label extends through this opening, while the label extends through another opening in the cover 144, similar to opening 30 described in connection with FIG. 1A. The peel bar 148 and its associated pinch roller 146 may be removed to print on linerless media.

The printing section of this embodiment has an automatic centering mechanism 150 for roll 24 with respect to printhead 20. The automatic centering mechanism 150 includes two edge guides 151 and 152. Edge guides 151 and 152 each have a flat surface facing the roll 24, except for a protruding member 155 from each edge guide which fits into the opposing ends of the core of roll 24. Support ribs 151*a* and 152*a* may be provided to edge guides 151 and 152, respectively. Edge guides 151 and 152 are each coupled to an edge guide rack 154 and 156, respectively, through a slot or opening 151*a* and 152*b*, respectively, in the interior surface 143 of housing 142. Each edge guide rack 154 and 156 has teeth 154*b* and 156*b*, respectively, which engage the teeth of a pinion gear 158, such that the edge guide racks 154 and 156 are coupled to each other to move in parallel reciprocal linear movement in opposite directions and centered with respect to print head 20 in compartment 22. The pinion gear 158 is located in the housing 142 at or near the center of the width of compartment 22. Each edge guide rack 154 and 156 has at least one edge which ride in a channel to facilitate the linear sliding of each rack. For purposes of illustration, rack channel 153 is only shown for edge guide rack 156.

Figure 11C:
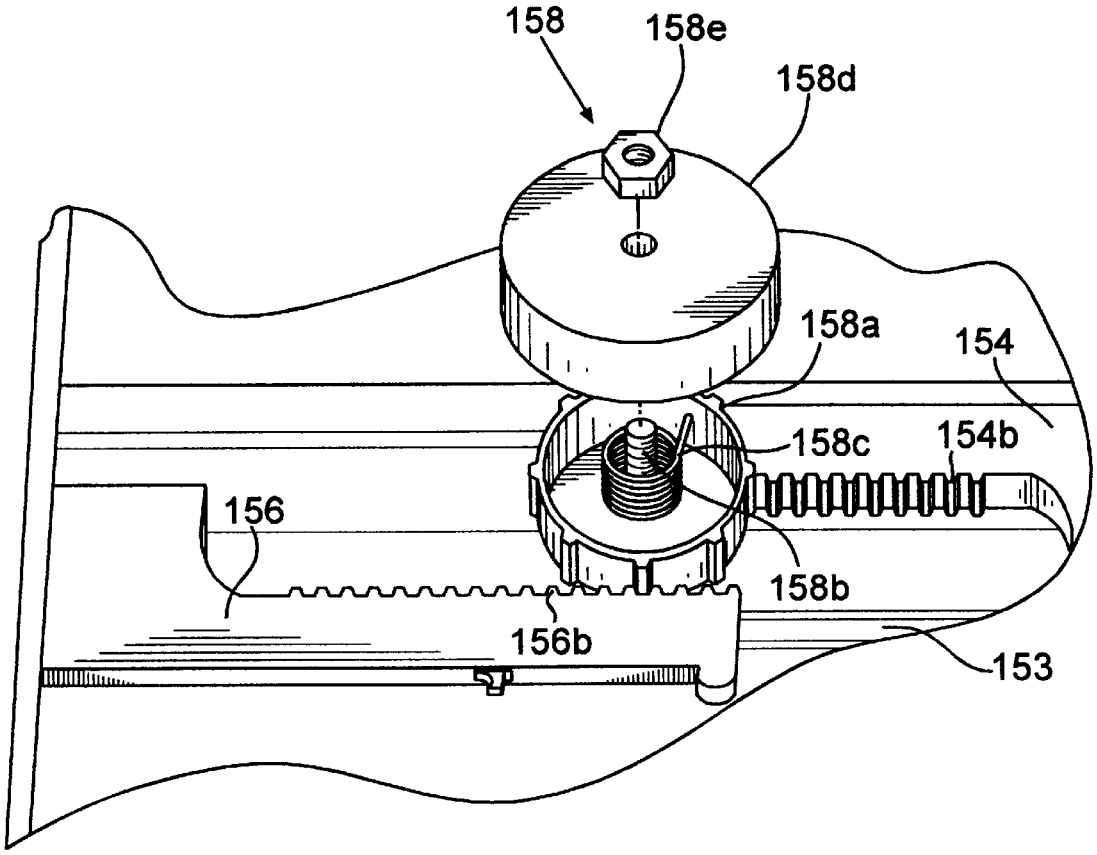
FIG. 11C is an exploded partial view of the automatic centering mechanism of FIG. 11A.

Referring to FIG. 11C, pinion gear 158 represents a pinion assembly, including a lower gear member 158*a* having teeth engaging the teeth of edge guide racks 154 and 156, a pinion bolt 158*b* from housing 144 which extends through an opening in lower gear member 158*a*, and a torsion spring 158c in the lower gear portion 158*a*. Spring 158*c* is coupled at one end to the bolt 158*b* and at its other end to the interior of lower gear member 158*a*, such that a rotational spring bias on the lower gear portion urges racks 154 and 156 and their respective edge guides 151 and 152 towards each other. The pinion assembly further includes an upper member 158*d* having a lower edge which is registered, or keyed, with the lower member 158*a*. Upper member 158*d* has an opening through which bolt 158*b* extends, and is retained in place by a nut 158*e* over the end of bolt 158*b*. The upper member 158*d* may be fixed to the lower member 158*a*, such that the upper and lower members can rotationally move as a unit with respect to the bolt 158*b* and 158*e*, or the upper member 158*d* may be fixed to bolt 158*b* by nut 158*e* and the upper member 158*d* and lower member 158*a* can rotationally slide with respect to each other. A bottom cover 160 (FIG. 11B) is provided to protect the cavity in housing 142 containing the automatic centering mechanism 150.

Figure 11D:
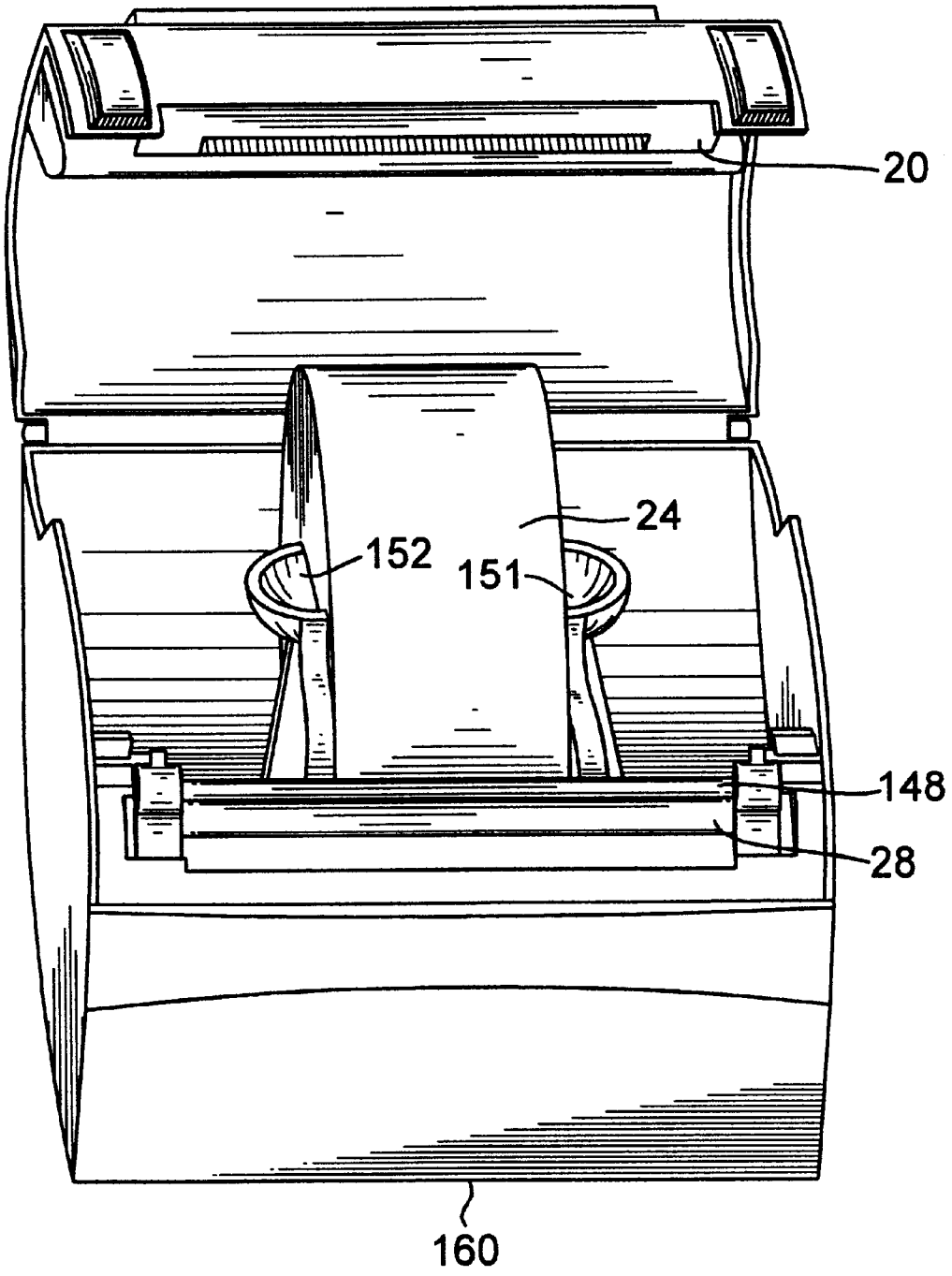
FIG. 11D is a perspective view of the printing section of FIGS. 11A and 11B with a different width roll.

As the edge guides 151 and 152 are urged together in the automatic centering mechanism 150, semicircular portions 151*c* and 152*c*, respectively, are provided to facilitate an operator's thumbs to move the edge guides away from each other for removing the core of a spent roll 24, or loading a new roll 24. The automatic centering mechanism allows the print section of this embodiment to accommodate rolls of different width. For example, a four inch roll is shown in FIG. 11B, while a smaller one inch width roll is shown in FIG. 11D. Other centering means may also be used, such as described in U.S. Pat. No. 5,813,343, which provides two racks which engage a pinion for centering a media roll, but requires a linear spring coupled directly to one of the racks, rather than a spring bias within a pinion gear assembly 150.

Although not illustrated, the end 162 of the printing section includes an end similar to the end 46*a* of the printing section 46 shown in FIGS. 2 and 3, such that the printing section as a module may be attachable to and detachable from the central control section 14. In the alternative, the printing section shown in FIGS. 11A–11C may operate as a stand alone printer with the inclusion of printer control circuitry on a printed circuit board in housing 142. The housing 142, cover 144, edge guides 151 and 152 and associated racks 154 and 156, may be made of molded plastic.

From the foregoing description, it will be apparent that improved portable label printer has been provided. Variations and modifications in the herein described printer in accordance with the invention will undoubtedly suggest themselves to those skilled in the art. Accordingly, the foregoing description should be taken as illustrative and not in a limiting sense.

What is claimed is:

1. A portable label printer comprising:

a housing having a control section and one or more detachable printing sections coupled to the control section;

said printing sections each comprising a printing mechanism with printing elements in which the printing mechanism is capable of printing on a different roll of paper or label stock;

said control section having means for controlling the printing by the printing mechanisms of said printing sections; and a battery in said housing for supplying power to the printer, wherein each of said printing sections further comprises:

a compartment for receiving a roll of paper having a cover which when in an open position enables loading of the roll of paper in said compartment;

a driving motor; and a platen roller rotatably mounted in the cover in which when said cover is in a closed position the surface of the platen roller faces the printing elements of the printing mechanism and the driving motor is rotationally coupled with the platen roller to drive the paper between said printing elements and platen roller and across the printing elements, and wherein said cover for each of said printing sections has an opening through which the paper from the roll in the respective compartment extends after passing across the printing elements.

2. The printer according to claim 1 wherein said controlling means operates responsive to signals from a host computer or terminal having information for printing by the printing mechanism of said printing sections.

3. The printer according to claim 1 wherein at least one of the printing sections represents a module detachable from the control section.

4. The printer according to claim 3 wherein different ones of said first and second printing sections accommodates paper of different widths.

5. The portable label printer according to claim 1 further comprising a terminal which is attachable to said control section of the housing, said terminal having means for communicating with the controlling means of the printer to operate at least one of the printing mechanisms of said printing sections.

6. The printer according to claim 5 wherein said terminal further comprises audio input and output means, and means for one of RF, cellular phone, or LAN-based communication by a user using said audio input and output means.

7. The printer according to said terminal is detachable from said printer and comprises a window and means for optically scanning through said window.

8. The printer according to claim 5 wherein said terminal has two ends which are at an angle with respect to each other.

9. The printer according to claim 1 wherein each of said printing sections further comprises a peeler bar for peeling labels from a paper carrier.

10. The printer according to claim 1 wherein said one or more detachable printing sections represents first and second printing sections.

11. The printer according to claim 10 wherein said first and second printing sections are located at opposite ends of said housing.

12. The printer according to claim 10 wherein said controlling section is central with respect to said first and second printing sections in said housing.

13. The printer according to claim 1 herein said housing weighs less than two pounds.

14. A portable label printer for printing on two separate rolls of paper or label stock comprising:

a housing having a control section and first and second printing sections coupled to the control section;

each of said first and second printing sections comprising a printing mechanism with printing elements in which the printing mechanism is capable of printing on different ones of said rolls of paper; and said control section having means for independently controlling the printing by the printing mechanisms of each of said first and second printing sections, wherein at least one of the first and second printing sections represents a module detachable from the control section.

15. The printer according to claim 14 wherein each of said printing sections further comprises:

a compartment for receiving a roll of paper having a cover which when in an open position enables loading of the roll of paper in said compartment;

a driving motor; and a platen roller rotatably mounted in the cover in which when said cover is in a closed position the surface of the platen roller faces the printing elements of the printing mechanism and the driving motor is rotationally coupled with the platen roller to drive the paper between said printing elements and platen roller and across the printing elements.

16. The printer according to claim 15 wherein at least one of said first and second printing sections further comprises a member movable along the cover of the printing section having a peeler bar which is locatable adjacent said platen of the printing section.

17. The printer according to claim 14 wherein each of said printing sections further comprises:

a housing having a compartment for receiving a roll of paper, a driving motor, and a platen roller rotatably mounted in the housing and rotationally coupled to said driving motor; and a cover coupled to said housing in which said printing elements are mounted, in which said printing elements face the surface of the platen roller when said cover in a closed position to drive the paper from the roll across the printing elements, and in an open position enables loading of the roll in said compartment.

18. The printer according to claim 14 wherein said printing sections each further comprise an opening through which said paper or label stock printed upon by said printing mechanism exits the printing section to a user of the printer.

19. The printer according to claim 14 wherein said controlling means operates responsive to signals from a host computer or terminal having information for printing by the printing mechanism of said printing sections.

20. The printer according to claim 14 wherein at least one of the printing sections represents a module detachable from the control section.

21. The portable label printer according to claim 14 further comprising a terminal, which is attachable to said control section of the housing, said terminal having means for communicating with the controlling means of the printer to operate at least one of the printing mechanisms of said printing sections.

22. The printer according to claim 21 wherein said terminal further comprises audio input and output means, and means for one of RF, cellular phone, or LAN-based communication by a user using said audio input and output means.

23. The printer according to claim 14 wherein each of said printing sections further comprises a peeler bar for peeling labels from a paper carrier.

24. The printer according to claim 14 wherein said housing weighs less than two pounds.

25. A portable label printer for printing on two separate rolls of paper or label stock comprising:

a housing having a control section and first and second printing sections coupled to the control section;

each of said first and second printing sections comprising a printing mechanism with printing elements in which the printing mechanism is capable of printing on different ones of said rolls of paper; and said control section having means for independently controlling the printing by the printing mechanisms of each of said first and second printing sections, wherein each of said first and second printing sections further comprises:

a compartment for receiving a roll of paper having a cover which when in an open position enables loading of the roll of paper in said compartment;

a driving motor; and a platen roller rotatably mounted in the cover in which when said cover is in a closed position the surface of the platen roller faces the printing elements of the printing mechanism and the driving motor is rotationally coupled with the platen roller to drive the paper between said printing elements and platen roller and across the printing elements, wherein each of said first and second printing sections further comprise a pair of hairpin springs which engage the ends of the platen roller of the cover of the printing mechanism when closed over the compartment associated with the printing mechanism, in which the hairpin springs align the platen roller with the printing elements of the printing mechanism, bias the platen roller into engagement with the printing elements, and latch closed the cover of the printing mechanism over the compartment associated with the printing mechanism.

26. The printer according to claim 25 wherein each of said first and second printing sections further comprise a train of one or more gears which mechanically couples the motor of the printing mechanism to the gear at the end of the platen roller of the cover of the printing mechanism when closed over the compartment associated with the printing mechanism to drive the platen roller and advance paper from the roll in the compartment associated with the printing mechanism across the printing elements of the printing mechanism.

27. A portable label printer for printing on two separate rolls of paper or label stock comprising:

a housing having a control section and first and second printing sections coupled to the control section;

each of said first and second printing sections comprising a printing mechanism with printing elements in which the printing mechanism is capable of printing on different ones of said rolls of paper; and said control section having means for independently controlling the printing by the printing mechanisms of each of said first and second printing sections, wherein each of said first and second printing sections further comprises:

a housing having a compartment for receiving a roll of paper, a driving motor, and a platen roller rotatably mounted in the housing and rotationally coupled to said driving motor; and a cover coupled to said housing in which said printing elements are mounted, in which said printing elements face the surface of the platen roller when said cover in a closed position to drive the paper from the roll across the printing elements, and in an open position enables loading of the roll in said compartment, wherein said roll has two ends, and said printer further comprises means for automatically centering the roll within the compartment, in which said means has two edge guides which retain the ends of the roll and said edge guides are coupled to each other through a pinion which spring biases the edge guides towards each other.

28. A terminal for a portable printer comprising:

a housing removably attachable to a portable printer;

a controller in said housing capable of communicating information to the portable printer;

audio input means and audio output means in said housing;

means for communication using said audio input means and audio output means for a user; and means for operating said terminal in response to voice commands from a user received via said audio input means.

* * * * *